US005606921A

United States Patent [19]

Elder et al.

[11] Patent Number: 5,606,921

[45] Date of Patent: Mar. 4, 1997

[54] STACKABLE PALLET

[75] Inventors: Andrew W. Elder, Carmel; William J. Skinner, Plainfield, both of Ind.

[73] Assignee: Stratis Corporation, Indianapolis, Ind.

[21] Appl. No.: 383,893

[22] Filed: Feb. 6, 1995

[51] Int. Cl.[6] ..... B65D 19/38

[52] U.S. Cl. ..... 108/53.3; 108/901; 108/53.1

[58] Field of Search ..... 108/51.1, 53.1, 108/53.3, 53.5, 901

[56] References Cited

U.S. PATENT DOCUMENTS

| | | | |
|---|---|---|---|
| 3,187,691 | 6/1965 | Leitzel | 108/901 X |
| 3,199,469 | 8/1965 | Sullivan | 108/53.3 |
| 3,228,358 | 1/1966 | Sepe et al. | 108/901 X |
| 3,424,110 | 1/1969 | Toot | 108/901 X |
| 3,526,195 | 9/1970 | Maryonovich . | |
| 3,880,093 | 4/1975 | Schott | 108/53.3 |
| 4,318,351 | 3/1982 | Munk | 108/901 X |
| 4,425,852 | 1/1984 | Riviere | 108/3.3 X |
| 4,838,176 | 6/1989 | Bowser, Sr. et al. | 108/53.3 |
| 5,046,434 | 9/1991 | Breezer et al. | 108/901 X |
| 5,341,748 | 8/1994 | Liu | 108/53.3 |
| 5,408,937 | 4/1995 | Knight, IV et al. | 108/53.3 X |

FOREIGN PATENT DOCUMENTS

| | | | |
|---|---|---|---|
| 0487180A1 | 5/1992 | European Pat. Off. . | |
| 0523737A2 | 1/1993 | European Pat. Off. . | |
| 0523737A3 | 1/1993 | European Pat. Off. . | |
| 2666069 | 8/1990 | France . | |
| 9002386 | 6/1991 | Netherlands | 108/53.3 |

*Primary Examiner*—Jose V. Chen

*Attorney, Agent, or Firm*—Merchant, Gould, Smith, Edell, Welter & Schmidt, P.A.

[57] ABSTRACT

A pallet includes a planar portion for supporting articles and feet extending from the bottom of the planar portion. The upper surface of the planar portion includes recesses formed therein having center islands extending upward even with the supporting surface. The feet include bottoms having a center recess and rim extending around the recess. The rim of the feet extend into the recess on the upper surface when the empty pallets are stacked and the center islands extend into the bottom recess of the foot to provide nesting and to prevent lateral sliding of the pallets.

13 Claims, 8 Drawing Sheets

STACKABLE PALLET

BACKGROUND OF THE INVENTION

1. Field of the Invention

The present invention relates to a loading pallet, and in particular, to a loading pallet which presents a flat supporting surface which prevents sliding when pallets are stacked while empty.

2. Description of the Prior Art

Pallets for supporting and moving various types of articles are well known. Pallets are made of many materials, including wood, metal, fiberglass or plastic, depending on the intended use and environment in which it is used. Pallets generally provide a support surface and are adapted for use with various types of loading equipment, including attachment to cranes or lifting by forklifts or pallet jacks.

Pallets are often constructed with a planar supporting portion and feet or runners extending downward therefrom to elevate the articles being supported off the ground to prevent moisture, dirt and other debris from coming into contact with the supported articles. When not in use, the pallets are typically stored in a stacked configuration. However, the stacks may become very high and the amount of space required for storing the pallets may be quite extensive. In addition, the pallets may easily slide relative to one another, making the stacks very unstable.

Difficulty arises when trying to design safeguards to prevent stacked empty pallets from sliding while maintaining a supporting surface which will not harm the articles being supported. Indentations in the supporting surface of the pallet have been made in some prior art pallets to align with the supporting feet when empty pallets are stacked, but these indentations may damage some of the soft goods supported on the pallets. For example, indentations on pallets supporting sheets of paper may cause indentations on the bottom sheets over the area spanning the indentations, as great weight is applied by the paper mass, which may often weigh more than a ton. This causes quality control problems and leads to a portion of the paper being unusable, thereby increasing costs.

It can be seen then that a pallet is needed which is lightweight and sufficiently strong to support heavy loads. In addition, such a pallet should provide a maximum supporting surface area which does not damage the articles being supported, yet provides for empty pallets being stackable in a manner in which they do not easily slide relative to one another. Moreover, such a pallet should provide some nesting capabilities so that the overall height of the stacked empty pallets is reduced. The present invention addresses these as well as other problems related to storage pallets.

SUMMARY OF THE INVENTION

The present invention is directed to a pallet, and in particular to a pallet having support members which engage recesses on an upper surface to prevent lateral sliding when empty pallets are stacked. A preferred embodiment of the pallet includes a planar portion which has an upper surface and a number of feet extending downward to elevate the planar portion off the ground. The upper surface of the pallet has island type support portions formed therein with recesses surrounding the support portions. The support portions and recesses are configured so that minimum distance is spanned so that impressions are not made into soft material when stored on the pallets.

The feet are configured with a bottom center recess and a wide rim type portion surrounding the recess. The support portions on the surface of the planar portion are aligned with the recesses in the lowermost portion of the feet. In addition, the rim portions of the feet are aligned with the recesses formed in the upper surface. Therefore, when empty pallets are stacked, the feet engage the recesses on the upper surface of the planar portion. This engagement prevents sliding of the empty pallets relative to one another in a stacked configuration.

The recess configuration also provides a degree of nesting so that the overall height of the empty pallets when stacked is decreased. Handles and other support may be molded into the pallets to provide for easier handling while maintaining a light weight.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
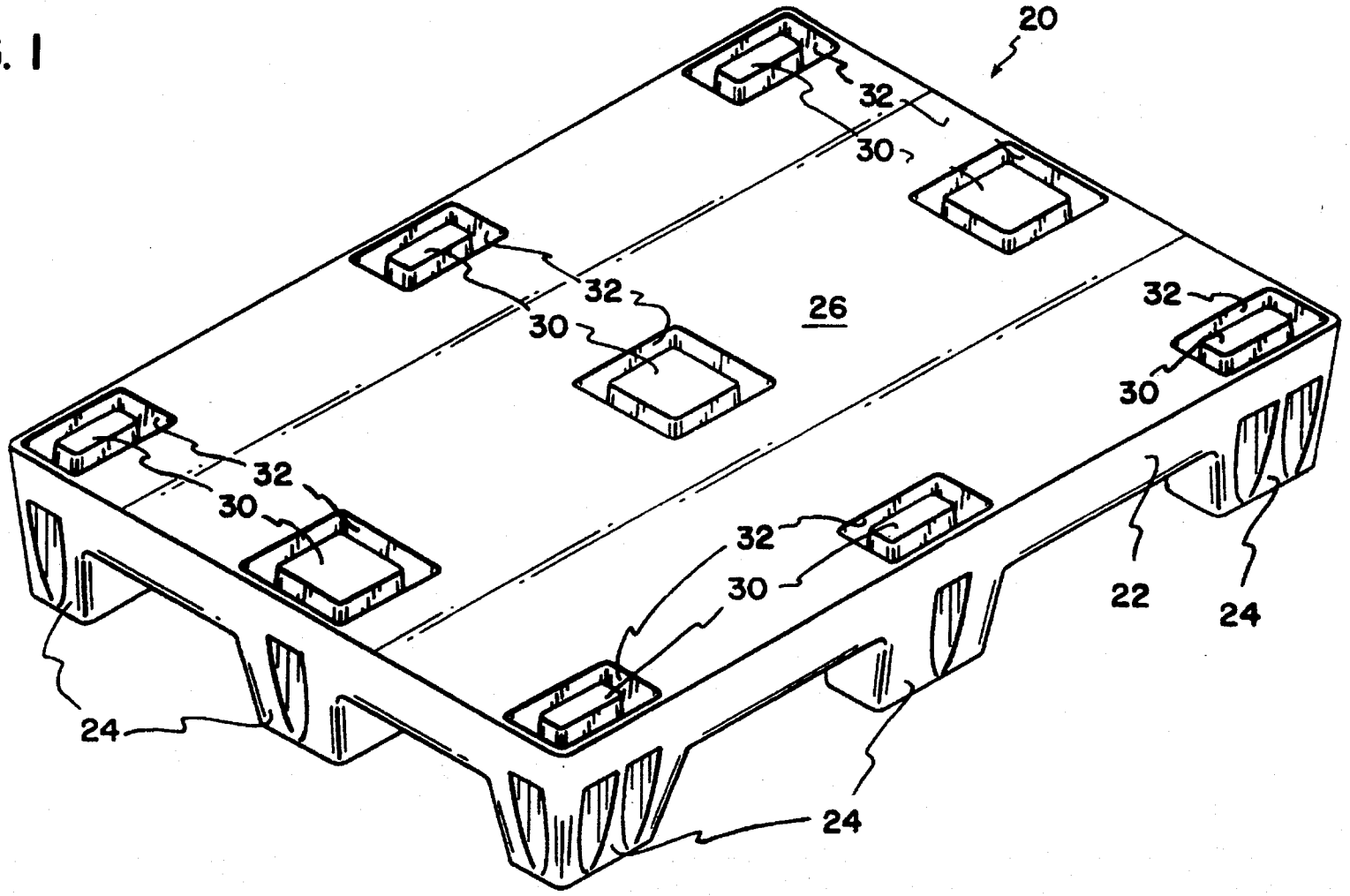
FIG. 1 shows a perspective view of a pallet according to the principles of the present invention.
Figure 2:
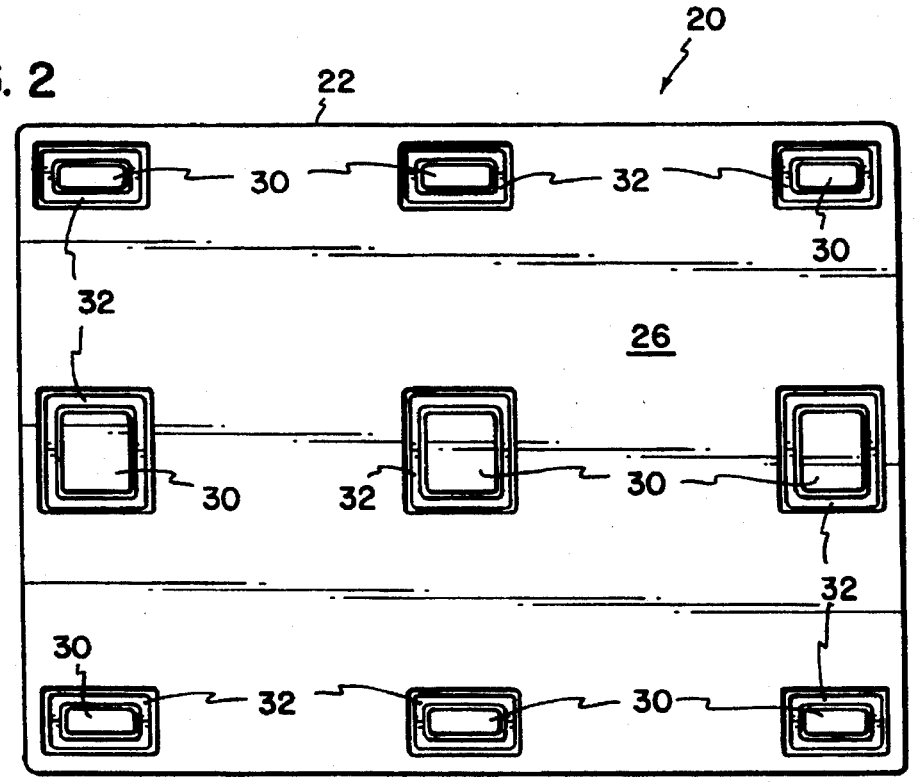
FIG. 2 shows a top plan view of the pallet shown in FIG. 1.
Figure 4:
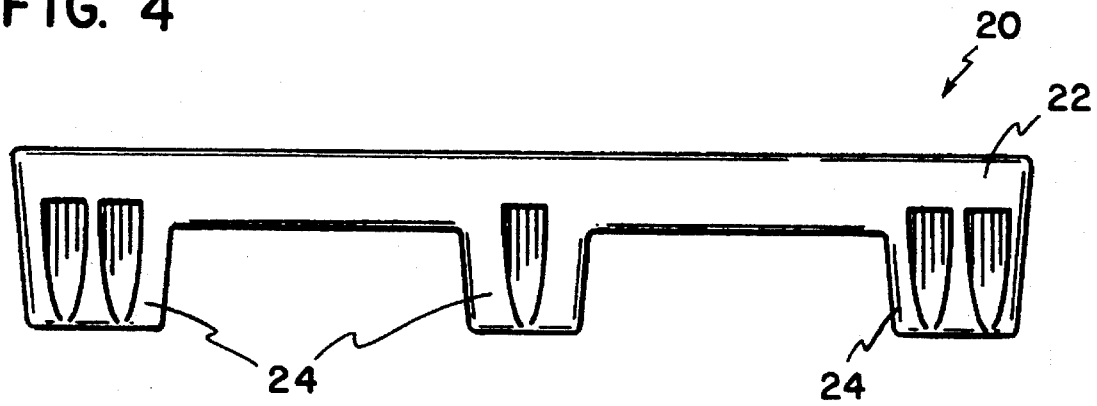
FIG. 4 shows a side elevational view of the pallet shown in FIG. 1.
Figure 5:
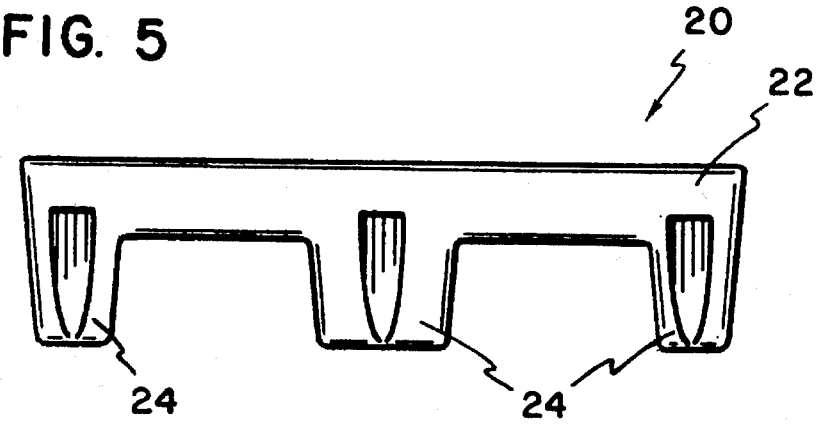
FIG. 5 shows an end elevational view of the pallet shown in FIG. 1.

Referring now to the drawings, wherein like reference numerals designate corresponding structure throughout the views, and referring in particular to FIG. 1, there is shown a first embodiment of a pallet, generally designated 20. The pallet 20 shown is a molded plastic, but other materials could be utilized as well. The pallet 20 includes a planar portion 22 having an upper surface 26 configured for supporting articles. A number of feet 24 extend from an underside of the planar portion 22 to provide for elevating the planar portion 22 off the ground, as also shown in FIGS. 4 and 5. The feet 24 are spaced so that fork lifts and pallet jacks can enter and support the pallet 20 from four directions. As shown in FIGS. 1 and 2, associated with each of the feet 24 are recesses 32 formed in the upper surface 26 and island type support portions 30 which extend upward from the center of the recesses 32 even with the upper surface 26. Although the support portions 30 and recesses 32 are shown as being generally rectangular, other shapes such as circles, ovals or squares may also be used.

Figure 3:
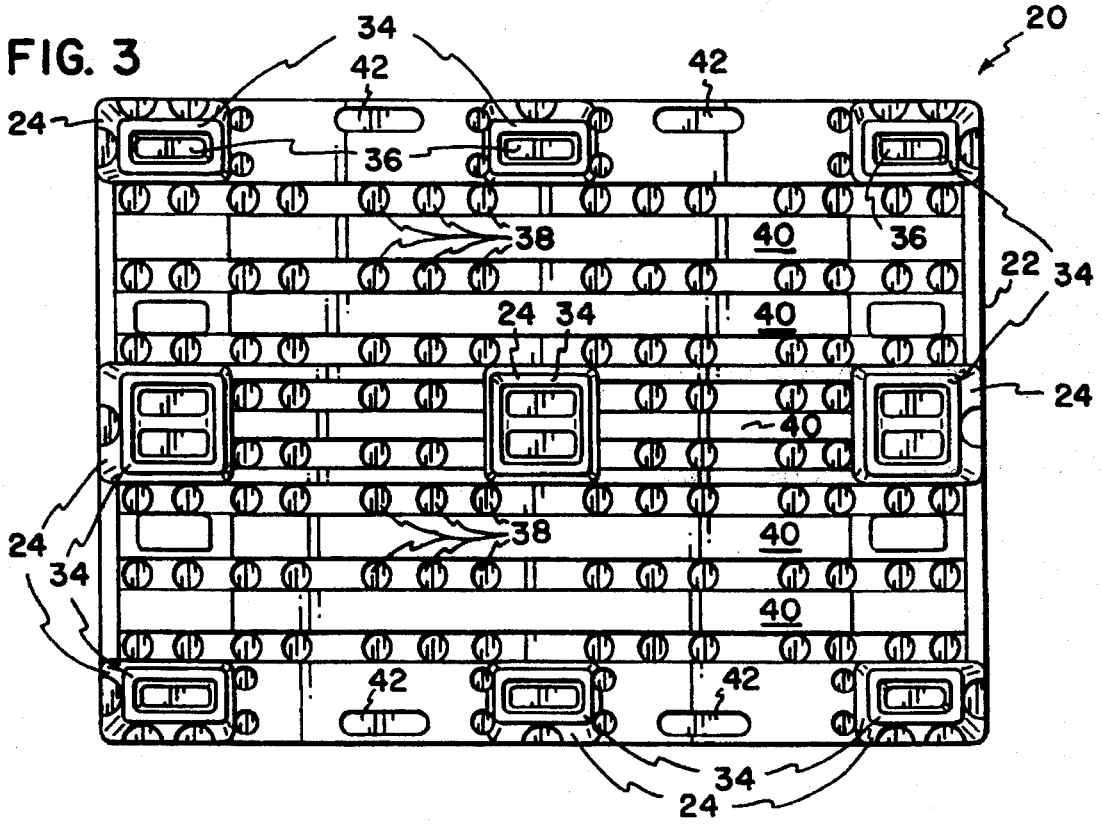
FIG. 3 shows a bottom plan view of the pallet shown in FIG. 1.

Referring now to FIG. 3, the underside of the planar portion 22 includes handle portions 42, which are molded at opposite sides for lifting and moving the pallet 20. A number of ridges 40 extend between support recesses 38 molded in the pallet 20 for reducing weight while providing added structural support. In the embodiment shown, having dimensions of approximately 48 by 40 inches, the plastic pallet 20 is capable of supporting dynamic loads of 2000 pounds and more and static loads of 3000 pounds and more. However, it can be appreciated that many pallet sizes may be used with the present invention.

Figure 6:
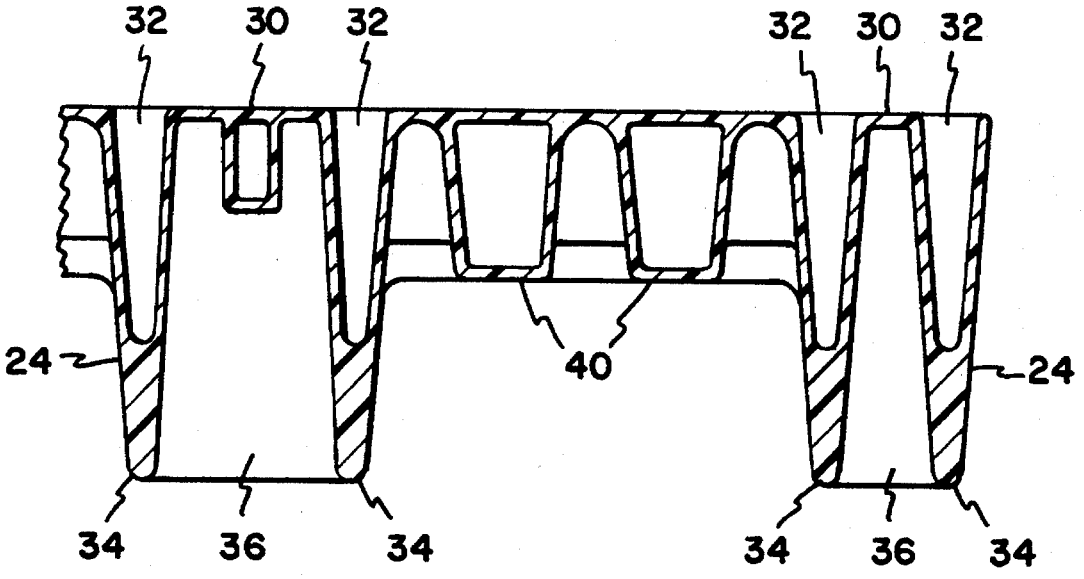
FIG. 6 shows a partial sectional view on the pallet shown in FIG. 1 taken through the support feet.
Figure 7:
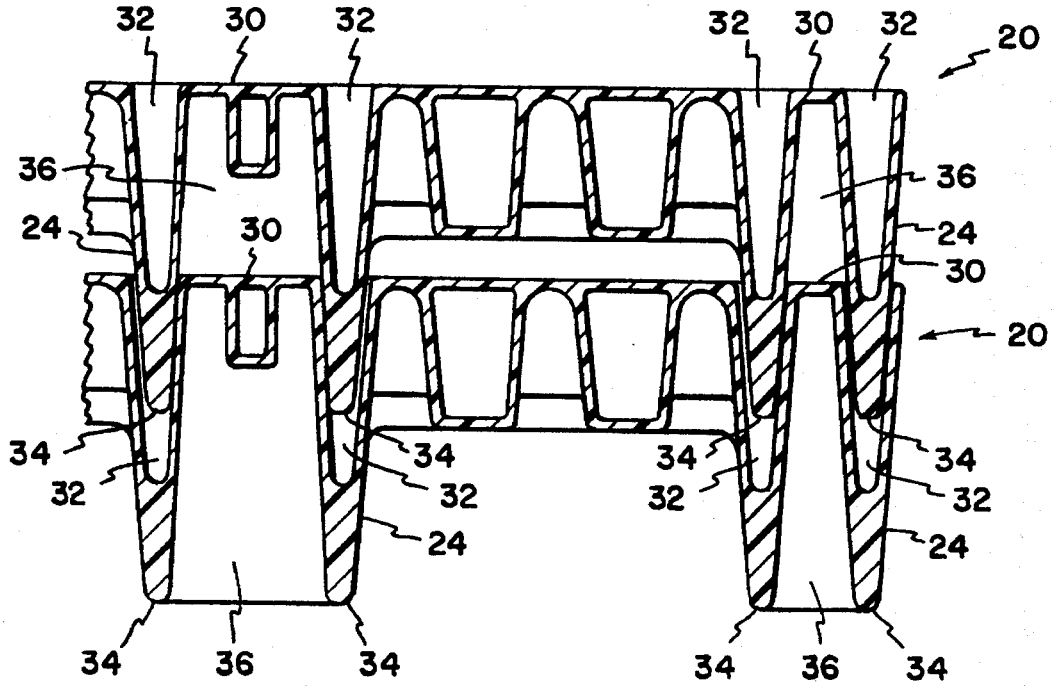
FIG. 7 shows a sectional view of two of the empty pallets shown in FIG. 1 stacked together.

The underside of each of the feet 24 includes a wide outer rim portion 34, as also shown in FIG. 6. The rim portion 34 surrounds a recess 36 which is configured for nesting with the center support portion 30. As shown in FIG. 7, when the empty pallets are stacked, the feet 24 nest with the rim portions 34 extending into the recesses 32 and the center portions 30 extend upward into the bottom recesses 36. It can be appreciated that this greatly decreases the overall height of a stack of empty pallets 20. In addition, this configuration prevents the pallets 20 from sliding laterally relative to one another. It can also be appreciated that the recess 32 provides a narrow distance to span between the center support portion 30 and the upper surface 26. This configuration maximizes surface area to support soft materials without damage.

Although nine feet 24 are shown, it can be appreciated that fewer or more feet may be utilized or that other support members, such as runners extending horizontally, may replace the feet while still providing a center support portion, a recess around the center support portion, and a bottom recess to provide nesting and to prevent lateral sliding of stacked empty pallets.

Figure 8:
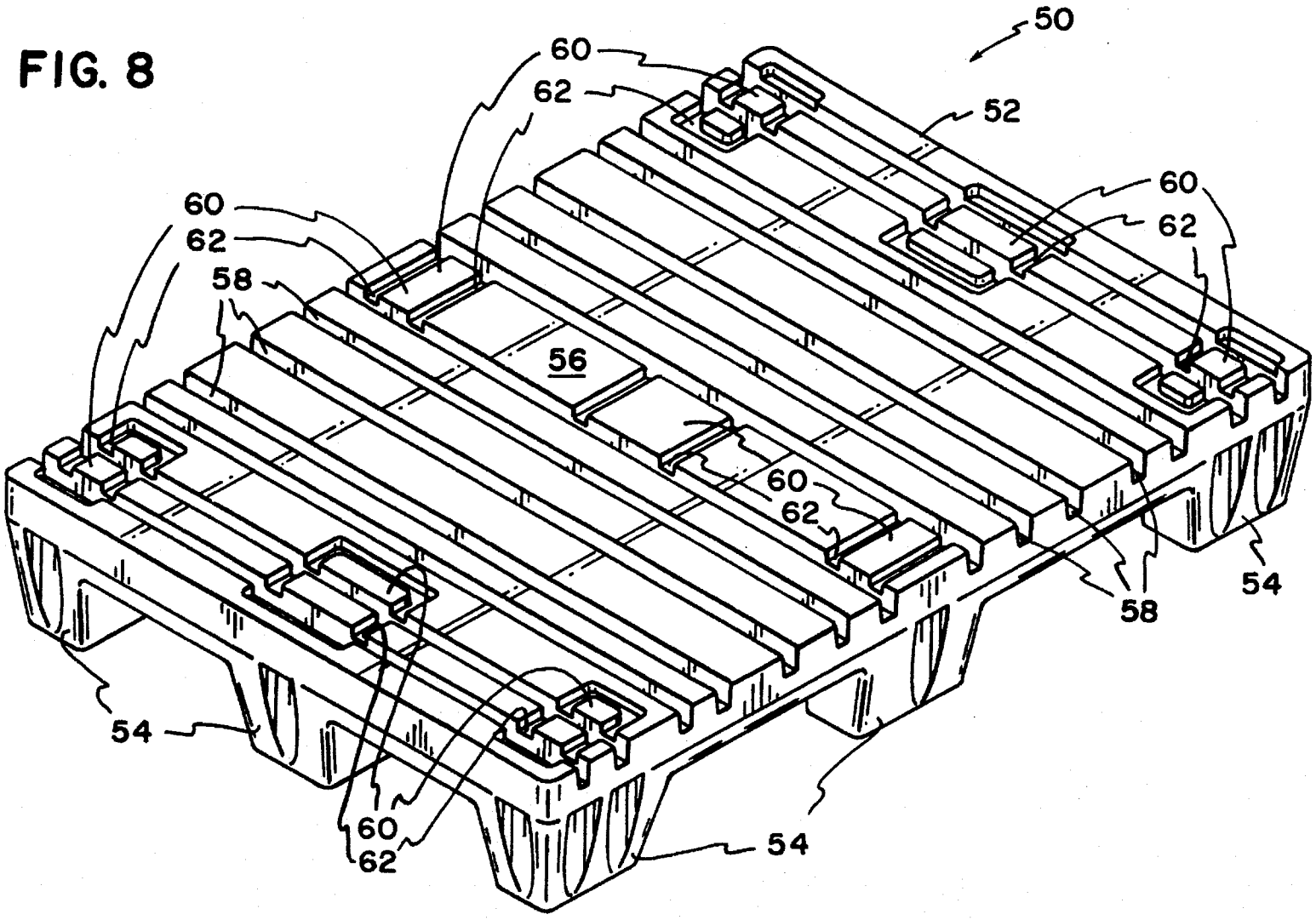
FIG. 8 shows a perspective view of a second embodiment of a pallet according to the principles of the present invention.
Figure 11:
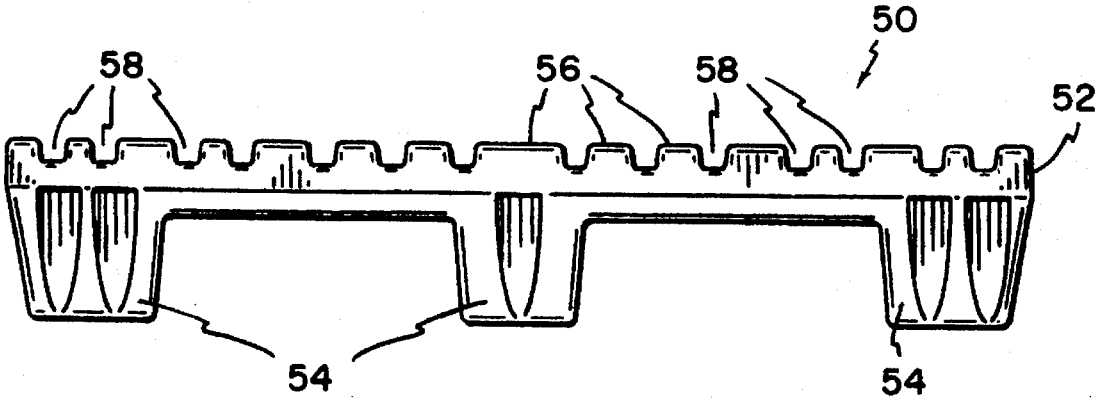
FIG. 11 shows a side elevational view of the pallet shown in FIG. 8.
Figure 12:
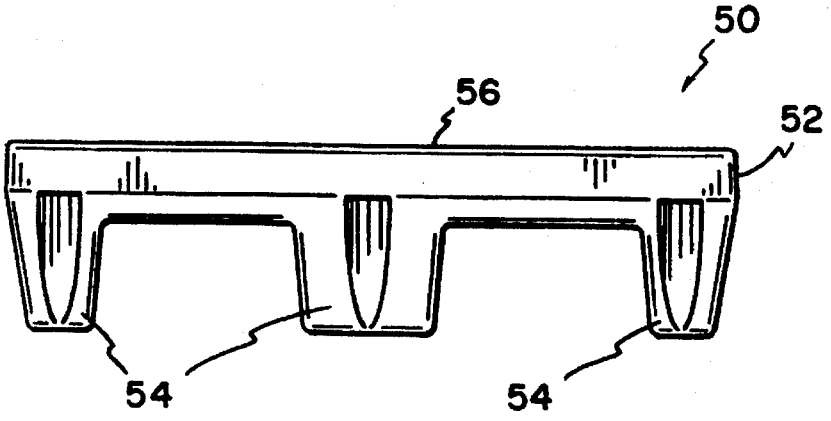
FIG. 12 shows an end elevational view of the pallet shown in FIG. 8.

Referring now to FIG. 8, there is shown a second embodiment of a pallet, generally designated 50. The pallet 50 includes a planar portion 52 which includes an upper surface 56 having a number of channels 58 extending across the pallet. Feet 54 extend from the planar portion 52 to raise the planar portion 52 off the ground, as also shown in FIGS. 11 and 12.

Figure 9:
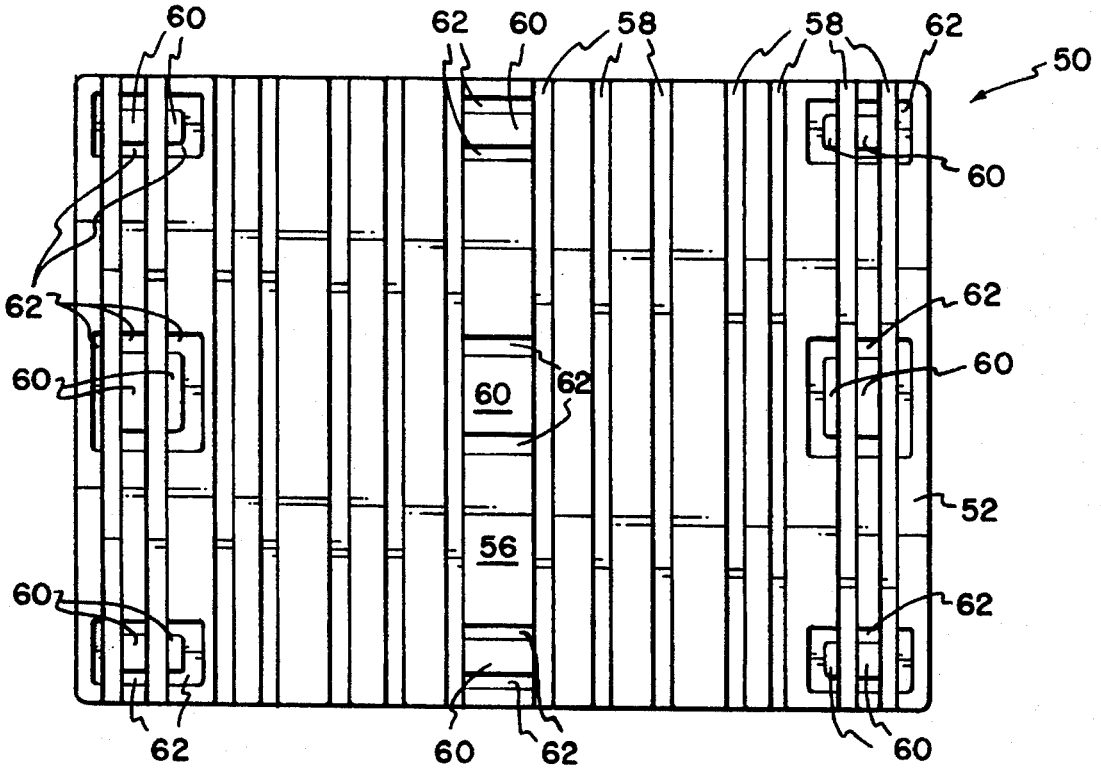
FIG. 9 shows a top plan view of the pallet shown in FIG. 8.

Referring again to FIGS. 8 and 9, the upper surface 56 has a number of support portions 60 formed therein corresponding to each of the feet 54. The support portions 60 include recesses 62 extending therearound to separate the support portions 60 from the upper surface 56. It can be appreciated that the center support portions 60 extend to a height even with the upper surface 56 of the planar portion 52 and provide maximum surface area for supporting articles on the pallet 50.

Figure 10:
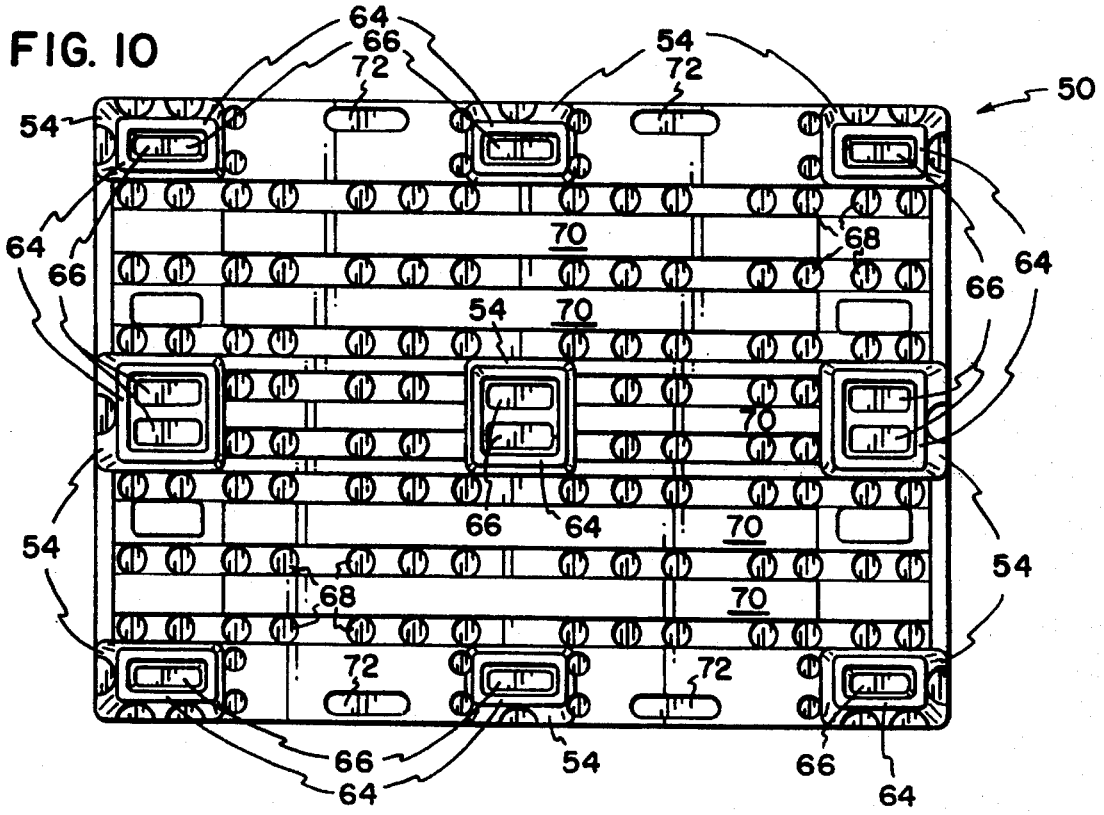
FIG. 10 shows a bottom plan view of the pallet shown in FIG. 8.

Referring now to FIG. 10, the underside of the pallet 50 is shown. The pallet 50 includes support ridges 70 and molded structural recesses 68 for adding strength to the plastic pallet 50. The feet 54 include rim portions 64 surrounding a recess 66. Handles 72 are molded into opposite edges of the underside of the pallet 50 to provide for lifting and carrying the pallet.

Figure 13:
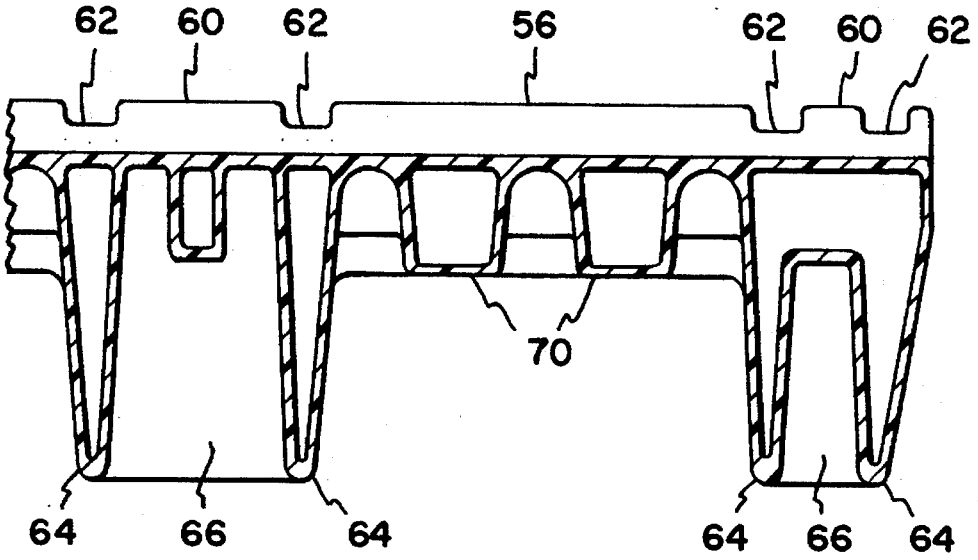
FIG. 13 shows a partial sectional view of the pallet shown in FIG. 8 taken through the support feet; and, FIG. 14 shows a partial sectional view of two of the empty pallets shown in FIG. 8 stacked together.
Figure 14:
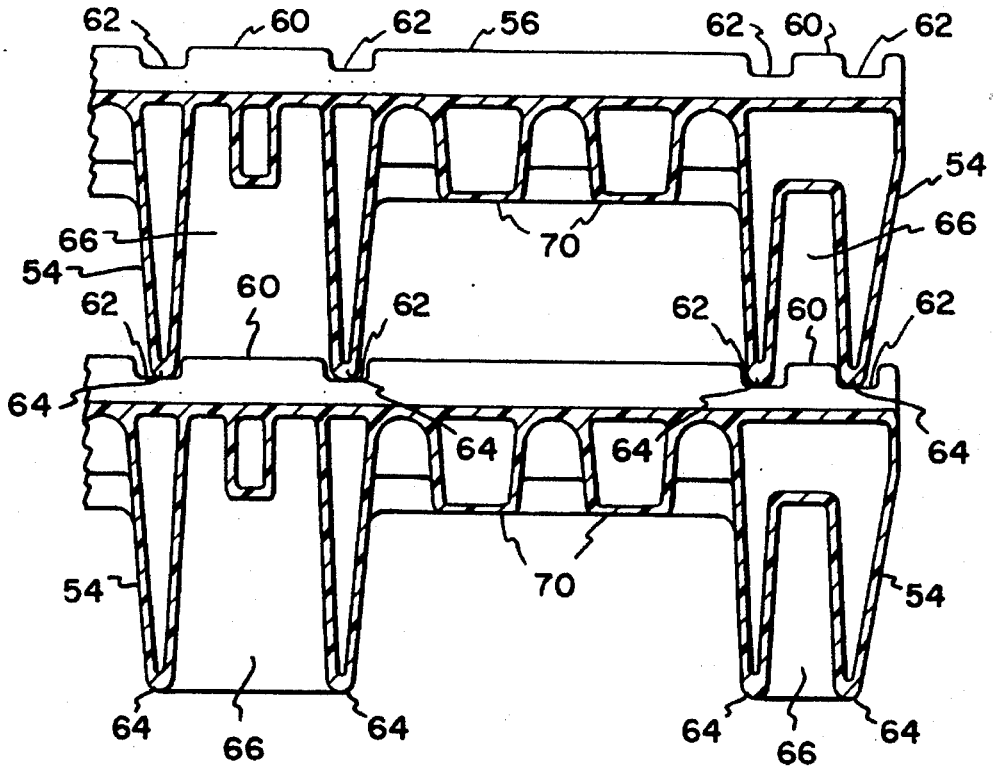

Referring now to FIGS. 13 and 14, the empty pallets 50 can be stacked so that the lower ridges 64 of the feet 54 engage corresponding recesses 62 when the pallets 50 are stacked. It can be appreciated that the bottom rim 64 of the feet 54 rest in the recess 62 to prevent sliding of the pallets 50 relative to one another when stacked while empty. In addition, the recesses 62 engaging the bottom portion 64 of the feet 54 provide slight nesting to reduce the overall height of the stack.

It can be appreciated that according to the present invention, pallets 20 and 50 are stackable and provide for nesting. The upper surface of the pallets 20 and 50 engaging the feet of a pallet stacked on the upper surface prevents sliding of the pallets laterally. In addition, center portions formed in the upper surface have recesses formed therearound. The recesses provide sliding prevention but do not detract from maximizing the supporting area of the upper surface. Center portions have a width which is sufficient so as not to form an indentation in the bottom sheets should papers or other similar soft materials be stacked on the pallets. In addition, the recesses are narrow enough so that an impression is not made into the bottom of soft materials. This provides for improved stacking and storage of the pallets while still providing sufficient support properties.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A pallet, comprising:

a support portion having a substantially planar upper supporting surface including a plurality of channels formed therein extending across the pallet;

a plurality of support members extending from the support portion;

wherein each of said support members include a rectangular central portion projecting substantially to the planar upper supporting surface and defining a recess around the central portion extending to a depth no greater than the channels, wherein each support member defines a bottom recess aligning with the central portion.

2. A pallet according to claim 1, wherein the bottom recess is selectively configured to receive the central portion of a corresponding support member on a second pallet when the pallets are stacked while empty.

3. A pallet according to claim 1, wherein the bottom recess and central portion are selectively configured to nest the pallets when stacked while empty.

4. A pallet according to claim 1, wherein the pallet is made of plastic, wood, metal, or resin-fiber composite.

5. A pallet according to claim 1, wherein the pallet includes nine support members extending from the planar supporting surface.

6. A pallet according to claim 1, further comprising handles molded into an underside of the support portion.

7. A pallet, comprising:

a support portion having a substantially planar upper supporting surface including a plurality of channels formed therein extending across the pallet;

a plurality of support members extending from the support portion;

wherein each of said support members include a central portion projecting substantially to the planar upper supporting surface and defining a recess around the central portion extending to a depth no greater than the channels, wherein each support member defines a bottom recess aligning with the central portion.

8. A pallet according to claim 7, wherein the bottom recess is selectively configured to receive the central portion of a corresponding support member on a second pallet when the pallets are stacked while empty.

9. A pallet according to claim 7, wherein the bottom recess and central portion are selectively configured to nest the pallets when stacked while empty.

10. A pallet according to claim 7, wherein the pallet is made of plastic, wood, metal, or resin-fiber composite.

11. A pallet according to claim 7, wherein the pallet includes nine support members extending from the planar supporting surface.

12. A pallet according to claim 7, further comprising handles molded into an underside of the support portion.

13. A pallet according to claim 7, wherein the central portion is rectangular.

* * * * *